United States Patent [19]

Normann, Jr.

[11] Patent Number: 4,809,417

[45] Date of Patent: Mar. 7, 1989

[54] METHOD OF MAKING A MULTIPLET JEWELRY PRODUCT WITH INTERNALLY EMBEDDED VISUAL INDICIA

[75] Inventor: George W. Normann, Jr., Beaverton, Oreg.

[73] Assignee: George Normann & Associates, Rosemount, Minn.

[21] Appl. No.: 825,045

[22] Filed: Jan. 31, 1986

[51] Int. Cl.[4] ..... A44C 17/00

[52] U.S. Cl. ..... 29/160.6; 63/32; 228/124; 228/263.12; 228/263.21

[58] Field of Search ..... 29/160.6; 63/32; 228/124, 263.12, 263.19, 263.21

[56] References Cited

U.S. PATENT DOCUMENTS

| | | | |
|---|---|---|---|
| 86,864 | 2/1869 | Richards | 63/32 |
| 1,745,607 | 2/1930 | D'esposito | 63/32 |
| 2,090,240 | 8/1937 | Strothman | 63/32 |
| 2,535,807 | 12/1950 | Moyd | 63/32 |
| 3,528,261 | 9/1970 | Jones | 63/32 |
| 3,621,442 | 11/1971 | Racht et al. | 228/124 R X |
| 3,808,836 | 5/1974 | Jones | 63/32 |
| 3,835,665 | 9/1974 | Kitchel | 63/32 |
| 3,864,939 | 2/1975 | Phillips et al. | 63/32 |
| 4,247,034 | 1/1981 | Burkart et al. | 228/263.12 X |
| 4,262,497 | 4/1981 | Morris et al. | 63/32 |
| 4,425,769 | 1/1984 | Hakoune | 63/32 |

FOREIGN PATENT DOCUMENTS

| | | | |
|---|---|---|---|
| 355204 | 7/1921 | Fed. Rep. of Germany | 63/32 |
| 2256955 | 11/1972 | Fed. Rep. of Germany | 63/32 |
| 0169251 | 11/1986 | Fed. Rep. of Germany | 63/32 |
| 785406 | 8/1935 | France . | |
| 822540 | 12/1937 | France . | |
| 30997 | 9/1964 | German Democratic Rep. | 63/32 |
| 8275 | 4/1894 | Switzerland | 63/32 |

*Primary Examiner*—Mark Rosenbaum
*Assistant Examiner*—Frances Chin
*Attorney, Agent, or Firm*—Klarquist, Sparkman, Campbell, Leigh & Whinston

[57] ABSTRACT

A multiplet jewelry product constructed of two or more layers of material affixed together having visual indicia secured therebetween is disclosed. Affixation is preferably accomplished using adhesive materials. The top layer of the multiplet jewelry product is constructed of a material sufficiently transparent to permit observation of the visual indicia. Subsequent layers of material consist of a selected transparent, semi-transparent or non-transparent gemstone materials. Visual indicia usable in the invention include symbolic representations, words, alphabet letters, pictures, designs, or objects. The completed product represents an attractive and unique jewelry item having an unusual and aesthetically desirable visual appearance.

15 Claims, 2 Drawing Sheets

METHOD OF MAKING A MULTIPLET JEWELRY PRODUCT WITH INTERNALLY EMBEDDED VISUAL INDICIA

BACKGROUND OF THE INVENTION

The present invention generally relates to a jewelry product, and more particularly to a multiplet jewelry product having internally embedded visual indicia.

Numerous techniques exist for making jewelry items having aesthetically desirable characteristics. For example, U.S. Pat. No. 86,864 to Richards involves a jewelry ornament manufactured from glass materials. A multi-colored glass sheet is heated and impressed with a die having a selected insignia thereon. Impression of the sheet produces a multi-colored product embossed with the insignia.

U.S. Pat. No. 3,835,665 to Kitchel describes a faceted gem having a colored substance placed in the interior thereof. A bore is drilled into the pavillion portion of the faceted gem and a colored substance is placed in the bore. Suggested colored substances includes dyes, pigments, colored beads, or colored wires.

Numerous patents exist which relate to jewelry items constructed of multiple gemstone elements. These patents include U.S. Pat. Nos. 3,864,939 to Phillips et al., 3,808,836 and 3,528,261 to Jones, and 4,262,497 to Morris et al. U.S. Pat. No. 3,528,261 to Jones involves a doublet gem having a crown member of one material, and a pavillion member of another material. The crown and pavillion members are cemented or interfacially seized to form a single gemstone unit. Suggested materials used to form the crown member include diamond, sapphire, spinel, topaz, or quartz. Suggested materials used to form the pavillion member include zircon, rutile, and strontium titanate. A similar gemstone construction is described in U.S. Pat. No. 3,808,836 to Jones.

U.S. Pat. No. 4,262,497 to Morris et al. describes a multiplet gemstone made from at least two pleochroic gemstone sections each having a different crystal orientation. Preferred gemstone materials used in the invention include alexandrite (containing chromium ion impurities), quartz, cordierite, and tourmaline.

U.S. Pat. No. 3,864,939 to Phillips et al. describes simulated gemstones manufactured from optical glass fiber materials. Specifically, each gemstone is constructed by cutting and polishing a hemispherical section from an optical glass fiber rod. Also described in the Phillips et al. patent is a doublet manufactured from a selected gemstone material preferably cut in cabochon form secured to a base plate manufactured of optical glass fiber material. Suggested gemstone materials used in the doublet include amethyst, sapphire, ruby, colored glass, or plastic. A suggested optical glass fiber material usable in the invention is flint glass having an optical index of 1.60–1.80 with a borosilicate glass coating having an optical index of 1.51 or less.

French Pat. Nos. 822,540 to Bruckner and 785,406 to Becker both describe methods for manufacturing decorative jewelry items. French Pat. No. 822,540 involves a jewelry/toy product having a body portion of transparent material with a picture or symbols positioned in the interior of the body portion. French Pat. No. 785,406 describes a gemstone having a design or letter formed in the surface of the stone. Formation of the design or letter is accomplished by selective cutting and polishing of the stone at predetermined locations.

The present invention involves a new and unique jewelry item constructed to produce a final product having unusual and desirable visual characteristics. Preferred materials and construction techniques used in manufacturing jewelry items having these characteristics are described in detail below.

SUMMARY OF THE INVENTION

It is an object of the present invention to provide a multiplet jewelry product having unique and aesthetically desirable visual characteristics.

It is another object of the present invention to provide a multiplet jewelry product which is easy to manufacture using a minimum number of process steps.

It is a further object of the present invention to provide a multiplet jewelry product having selected visual indicia permanently embedded therein.

It is an even further object of the present invention to provide a multiplet jewelry product of durable, permanently bonded construction.

The invention as described herein involves a multiplet jewelry product constructed of two or more layers of material affixed together and having visual indicia secured therebetween. Affixation is preferably accomplished using adhesive materials. The top layer of the multiplet jewelry product is constructed of a transparent material permitting observation of the visual indicia. Subsequent layers of material consist of selected transparent, semi-transparent, or non-transparent gemstone materials. Visual indicia usable in the invention include symbolic representations, alphabet characters, words, pictures, designs, or objects.

These and other objects, features, and advantages of the invention will become apparent hereinafter from the following drawings, detailed description, and claims.

DETAILED DESCRIPTION

Figure 1:
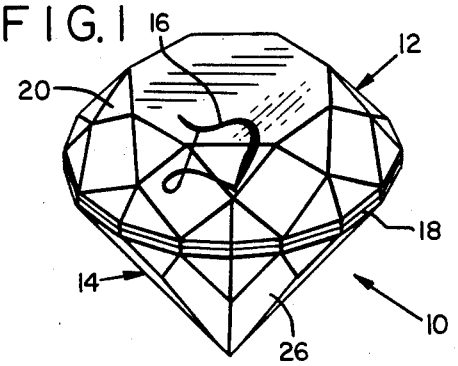
FIG. 1 is a perspective view of one embodiment of the present invention.
Figure 2:
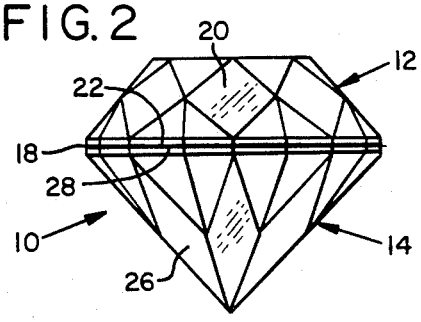
FIG. 2 is a side view of the embodiment of FIG. 1.

A multiplet jewelry product 10 constructed in accordance with the present invention is shown in FIGS. 1–4. The multiplet jewelry product 10 consists of a top layer 12, a bottom layer 14, and visual indicia 16. In the embodiment of FIGS. 1–4, the top layer 12 and bottom layer 14 are secured together using a transparent, colorless adhesive layer 18 of greater thickness than the visual indicia 16. In other embodiments, the adhesive layer may be colored if desired.

Figure 3:
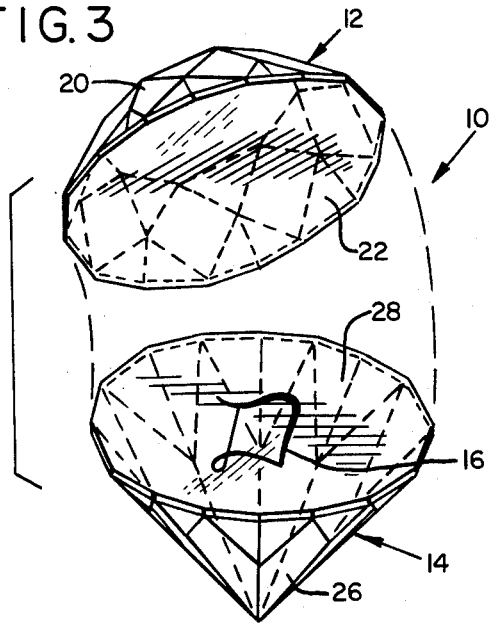
FIG. 3 is an exploded perspective view of the embodiment of FIG. 1 prior to the application of adhesive materials.
Figure 4:
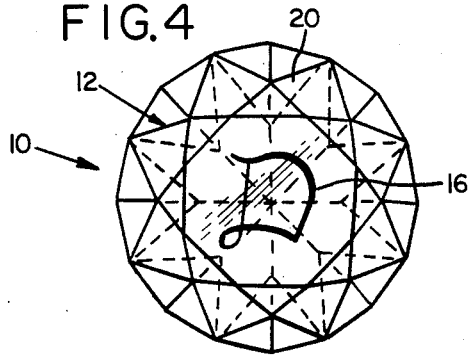
FIG. 4 is a top view of the embodiment of FIG. 1.

With reference to FIG. 3, the top layer 12 includes an outer surface 20 and an interfacial surface 22. The outer surface 20 may be fashioned in a variety of ornamental forms, including a faceted construction resembling a crown as shown in FIGS. 1–4, or a cabochoned design.

The top layer 12 consists of a durable material sufficiently transparent to permit observation of the visual indicia 16 within the multiplet jewelry product 10. Examples of such a material include diamond, corundum, spinel, quartz, glass, cubic zirconia, strontium titanate, beryl, topaz, or plastic. These and other materials used to construct the top layer 12 may be colored or colorless. Although the top layer 12 preferably consists of a single layer of material, it may also be constructed of a plurality of material sections secured together in an adjacent, side-by-side relationship. The sections would be adhesively affixed together, or adjoined using optical interfacial seizure. Optical interfacial seizure involves the molecular cohesive attraction between two pieces of material having complementary mating surfaces.

The top layer 12 may also include at least one non-transparent area. For example, the top layer 12 may be constructed of a material having a partially opaque or semi-transparent area with at least one zone of transparency therein through which the visual indicia may be viewed. An example of such a material would include a glass or plastic layer having a transparent zone surrounded by areas which have been colored or darkened through, for example, the use of tints or dyes.

The bottom layer 14 includes an outer surface 26 and an interfacial surface 28. The outer surface 26 may be fashioned in a variety of ornamental forms, including a faceted construction resembling a pavillion as shown in FIGS. 1–4, or a cabochoned design.

The bottom layer 14 consists of a decorative gemstone material having an attractive visual appearance. Examples of such a material include diamond, corundum, beryl, topaz, quartz, jadeite, nephrite, lapis lazuli, opal, tiger-eye, obsidian, basalt, spinel, glass, cubic zirconia, strontium titanate, polycrystalline silica, mother-of-pearl, and zircon. The term "gemstone" as used herein shall also include other decorative materials having an attractive visual appearance. Examples of such materials include decorative and polished amber, ivory, metal, plastic, and wood. The bottom layer 14 can also consist of a material that has important functional characteristics (e.g. material used as the bottom portion of an opal triplet or material which is used as a backing agent.) Examples of such a material include pitch, black onyx, black glass, metal, plastic, and wood. Although the bottom layer 14 preferably consists of a single piece of gemstone material, it may also be constructed of a plurality of gemstone segments secured together in an adjacent side-by-side relationship. These segments would be adhesively affixed together, or adjoined using optical interfacial seizure.

The interfacial surfaces 22, 28 are complementary in shape and preferably planar as shown in FIGS. 1–4. They are sized for precise mating engagement with each other. The interfacial surfaces 22, 28 may also be non-planar in shape. However, if non-planar, interfacial surfaces 22 and 28 should be complementary in shape, and sized to permit the precise mating interengagement of such surfaces.

The visual indicia 16 shown in FIGS. 1–4 consists of an initial made of a selected colored material However, an infinite number of visual indicia forms may be used. These forms include designs, pictures, symbols, alphabet characters, words, and objects. The designs, pictures, symbols, alphabet characters, and words preferably consist of colored or blackened materials, including metal (e.g. gold, platinum, silver, palladium, steel, copper, brass, bronze, aluminum, and titanium), paint, dye, ink, stain, resinate, ceramic decorating agents, or decal materials. The objects usable as visual indicia include miniature charms, coins, insects, a portion of material containing a holographic image, or an electronic display unit such as a liquid crystal panel connected to an external power source.

AS described above, the visual indicia 16 is fixedly positioned between the top layer 12 and bottom layer 14. As shown in FIGS. 1–4, the visual indicia 16 is applied to the interfacial surface 28 of the bottom layer 14 prior to attachment of the top layer 12 thereto. However, the visual indicia may be affixed in the same manner to the interfacial surface of the top layer of material. Also, separate visual indicia may be affixed to the interfacial surfaces of both the top and bottom layers.

Prior to the affixation of the visual indicia in the present invention, each of the interfacial surfaces involved should be thoroughly polished if necessary, and cleaned. Thereafter, affixation of the visual indicia to the selected interfacial surface(s) may be accomplished using adhesive materials. Also, in the case of certain inks, dyes, or pigments, the visual indicia may be applied directly to the interfacial surface(s), adhering without the use of adhesives Some materials (e.g. certain metals) will require the application of a bonding substrate to the selected interfacial surface(s), depending on the type of material being used. The use of a bonding substrate is specifically described in the Example set forth below.

Figure 5:
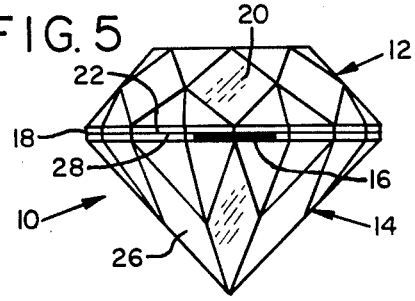
FIG. 5 is a side view of another embodiment of the present invention.

In the present invention, the visual indicia may be physically embedded within the interfacial surface of the top, bottom, or both layers of material being used. For example, the visual indicia may involve physically etching a selected design or insignia into the interfacial surface(s). As shown in FIG. 5, the visual indicia 16 is within the surface 28 of the bottom layer 14. If desired, the voids or affected surfaces created by such etching may be filled partially or entirely with a selected decorative material (e.g. ink, stain, or plastic). Embodiments of the invention having visual indicia directly embedded within the interfacial surface(s) will permit the use of optical interfacial seizure to secure the material layers of the multiplet jewelry product together. However, for optical interfacial seizure to be used successfully, the visual indicia must be below the opposing interfacial surfaces involved in order to permit the cohesive mating engagement of the opposing interfacial surfaces to each other.

Figure 7:
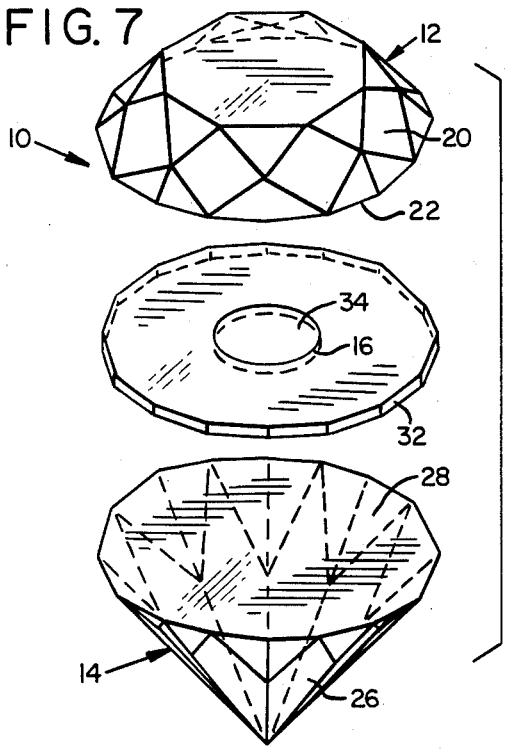
FIG. 7 is an exploded perspective view of the embodiment of FIG. 6.
Figure 6:
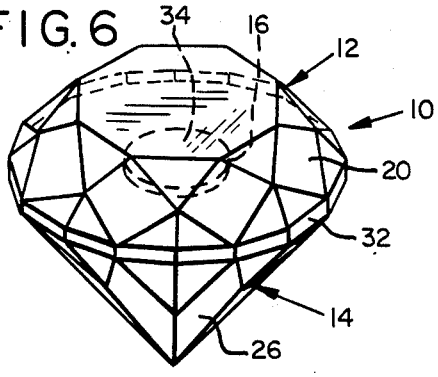
FIG. 6 is a perspective view of another embodiment of the present invention.

As shown in FIGS. 6 and 7, the visual indicia 16 may be affixed to or within a thin layer of material 32 which has at least one transparent area therein. The transparent area in the thin layer of material 32 shown in FIGS. 6 and 7 encompasses the entirety of the layer. This technique is especially useful when the visual indicia 16 consists of an object 34. The layer of material 32 containing the object 34 is affixed to and between interfacial surfaces 22, 28 to form the multiplet jewelry product 10.

Figure 8:
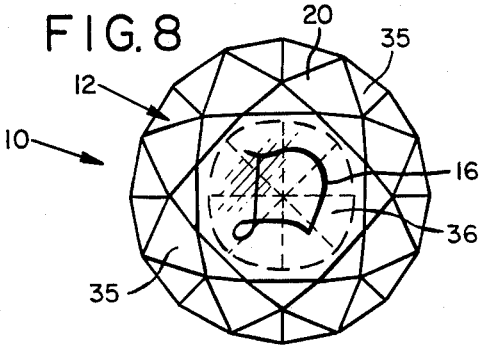
FIG. 8 is a top view of another embodiment of the present invention.

With reference to FIG. 8, the top layer 12 may also include a non-transparent area 35. As shown in FIG. 8, the top layer 12 has a transparent zone 36 therein through which the visual indicia 16 may be viewed.

Notwithstanding the type of visual indicia used, or the method by which such visual indicia is affixed to the interfacial surfaces of the invention, both interfacial surfaces should be thoroughly polished (if necessary) and cleaned before assembly of the final product. Failure to properly polish and clean these surfaces may result in a final product having an undesirable, defective appearance.

The completed multiplet jewelry product is characterized by an unusual and aesthetically pleasing visual appearance. The visual indicia may be viewed through the top layer and will appear prominently within the interior of the product. The exterior of the completed product may take various forms, including faceted or cabochon designs with or without girdles. Whether or not the finished product will contain a girdle is generally determined by the overall shape of the product. Certain shapes, including briolettes, spheres, and egg-shaped designs, will not have girdles. If a girdle is part of the design being used, the style thereof will be either a "knife-edge" girdle or a girdle having a flattened peripheral portion. It is preferred that the jewelry products of the present invention be fashioned in a decorative manner after assembly. However, it is possible to individually fashion each of the outer surfaces of the material layers involved before assembly. Regardless of form, the completed product represents an attractive and unique jewelry item usable in a variety of applications, including rings, watches, pendants, bracelets, necklaces, and the like.

Finally, the embodiment illustrated in FIGS. 1–4 consists of a "doublet" having two portions. Also within the scope of the invention is a product having more than two layers of material affixed together with visual indicia selectively positioned therebetween. Such a product would be constructed using the same techniques described above, with the addition of as many supplementary layers of material and visual indicia as desired.

EXAMPLE

Figure 9:
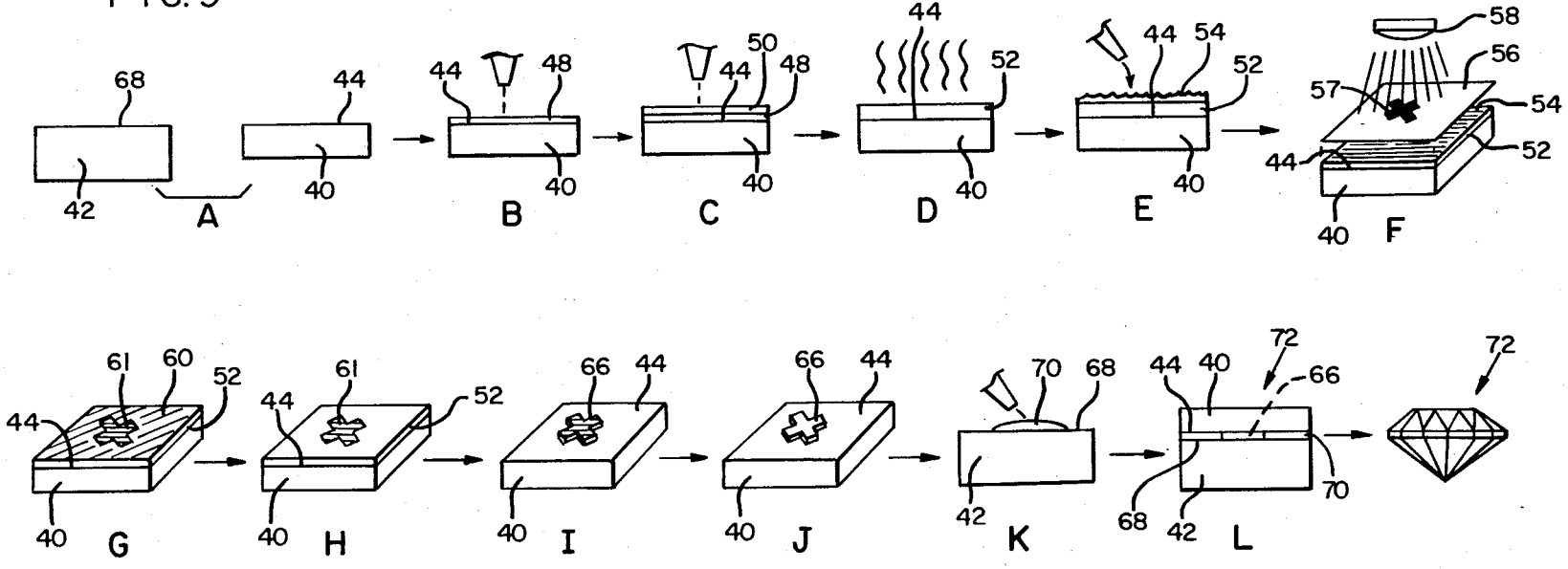
FIG. 9 is a sequential schematic representation of the production steps necessary to produce a multiplet jewelry product in accordance with the present invention.

The Example set forth herein and shown in FIG. 9 involves a doublet jewelry product having an internally embedded layer of gold material. As shown in FIG. 9A, top and bottom layers 40, 42 are initially provided in an uncut form. Decorative cutting occurs after completion of the product in this example. The top layer 40 consists of a square piece cut from a sheet of transparent, colorless fused quartz having a planar interfacial surface 44 to which the visual indicia will be affixed, as described below. The bottom layer 42 consists of a section cut from a ½ boule portion of clear red synthetic corundum. The bottom layer 42 also has a planar interfacial surface which has been cut and polished.

Prior to affixation of the visual indicia, the interfacial surface 44 is thoroughly cleaned and prepared. The first step in this procedure is accomplished by using a mixture of deionized water and optical grade cerium oxide. Polishing of the interfacial surface 44 in this example is not necessary by virtue of the quartz material used to construct the top layer 40. Next, the interfacial surface 44 is cleaned with a suitable laboratory cleaning/degreasing agent (e.g. Micro® manufactured by the International Products Corporation.) The interfacial surface 44 is then rinsed with deionized water, followed by the application of an anhydrous, non-ionic surfactant (e.g. Tritron N101® manufactured by the Rohm & Haas Company.) Thereafter, the interfacial surface 44 is again rinsed with deionized water and immersed in electronic grade isopropyl alcohol. The isopropyl alcohol removes all residual traces of water from the interfacial surface 44. The final step in the cleaning and preparation procedure involves immersion of the top layer 40 in a Freon degreasing station (containing TFE Freon) to remove any traces of the isopropyl alcohol. To determine if all contaminants have been removed, the interfacial surface 44 is passed under a narrow beam, high-intensity light source, and carefully observed. Any remaining contaminants-will appear as faint streaks or small spots. If such streaks or spots are noted, further cleaning is necessary. It is especially important that the interfacial surface 44 be completely clean in order to ensure proper adhesion of the visual indicia.

The visual indicia in the present example consists of a decorative gold design. It is deposited on interfacial surface 44 of the top layer 40 using a 25 inch Varian (Model No. 3120) planetary vacuum deposition station in combination with a four pocket Sloan Company electron beam gun and a Laybold Heares Inficon IC 6000 deposition/rate controller (oscillating quartz crystal type) Using this apparatus, a 35 angstrom zirconium coating 48 is first deposited on the interfacial surface 44, as shown in FIG. 9B. The zirconium coating functions as a bonding substrate for the subsequent deposition of a gold coating Gold has a low adhesion capacity for quartz and will not effectively bond thereto without an appropriate bonding substrate. Next, a 1000 angstrom gold coating 50 is deposited on the zirconium coating 48 (FIG. 9C). The top layer 40 is then placed within the inner baking chamber of a forced nitrogen oven. The oven is then brought up to a temperature of 430° C. at a linear rate of progression over a period of one hour, held at 430° C. for one hour thereafter, and lowered at the same linear rate. Baking causes the gold and zirconium coatings to combine, producing a composite gold layer 52 having desirable color and reflective characteristics (FIG. 9D).

Next, the gold layer 52 is coated with a layer of photoresist material 54 (FIG. 9E). Photoresist material is a light sensitive masking agent used in various applications to create image patterns. After application of the photoresist material 54, a piece of exposed graphic arts photographic film 56 having a selected image 57 is placed and centered (with the emulsion side down) on the photoresist material 54. The image 57 on the photographic film 56 is in positive form, and right-reading when viewed from its emulsion side. Thereafter, the photoresist material 54 and exposed graphic arts photographic film 56 are temporarily secured together using a conventional vacuum frame apparatus and exposed to a light source 58, as shown in FIG. 9F.

Exposure to the light source 58 produces an exposed photoresist portion 60 surrounding an unexposed photoresist portion 61 on top of the goldllayer 52. The unexposed photoresist portion 61 corresponds to the image 57 on the film 56, as represented in FIG. 9G. Next, the top layer 40 is immersed in a photochemical developer solution. As a result, the only part of the gold layer 52 having photoresist materials remaining thereon is the unexposed portion 61 (FIG. 9H). The exposed portion 60 will have been developed and washed away.

Next, the top layer 40 is immersed in an etching solution of iodine and potassium iodide. The etching solution removes all portions of the gold layer 52 not covered by photoresist material. Portions of the gold layer 52 covered by photoresist material will remain on the interfacial surface 44 of the top layer 40, forming a gold design 66 (FIG. 9I). The top layer 40 having gold design 66 thereon is then immersed in acetone to remove the remaining photoresist material from the gold design 66 (FIG. 9J).

Finally, the gold design 66 is washed with a detergent, rinsed with deionized water, and dried with compressed air. The completed top layer 40 is placed in a lint free atmosphere until final assembly of the product.

The bottom layer 42, having a cut and polished planar interfacial surface 68 thereon, is then prepared for affixation to the interfacial surface 44 of the top layer 40. The interfacial surface 68 is cleaned and prepared using the same procedure described above for the interfacial surface 44 of the top layer 40. Thereafter, the interfacial surface 68 is inspected for lint which is blown away using compressed air, if necessary.

After final visual inspection of both interfacial surfaces 44, 68 for lint and contaminants, the top and bottom layers 40, 42 are ready for affixation. First, a drop of adhesive material 70 is deposited on top of the interfacial surface 68 of the bottom layer 42, as shown in FIG. 9K. An effective adhesive material used in the present invention is a high viscosity, ultraviolet-curing composition sold under the name Impruv ® No. 365 by the Loctite Corporation. This material has a modified acrylate resin base, and will cure using high intensity long-wave ultraviolet light in the 365 nm range. UV cure is a function of the color of the materials being used, the UV light source involved, and the thickness of the adhesive material. Typical cure speed varies from 5 to 30 seconds when exposed to UV light intensity of 100 $mw/cm^2$.

The interfacial surface 44 of the top layer 40 is then pressed against the adhesive material 70 and the interfacial surface 68 of the bottom layer 42, making sure that the gold design 66 is properly centered in relation to the bottom layer 42 (FIG. 9L). Next, gentle pressure is applied to the top and bottom of the assembled product 72 so that any bubbles in the adhesive material 70 will be forced out. It may be necessary to gently slide the top layer 40 in one or more directions to remove bubbles from the adhesive material 70.

After removal of all bubbles, the adhesive material 70 is allowed to set. If an ultraviolet-cured adhesive is used, the assembled product is exposed to sufficient amounts of ultraviolet light necessary for proper solidification of the adhesive. In the present Example, a 15 watt General Electric black-light bulb was used for approximately 10 minutes. The adhesive material 70 is transparent when cured and of greater thickness than the gold design 66. Finally, after curing of the adhesive material 70, the assembled product 72 is cut in a desired form.

In preparing all embodiments of the invention, two procedures are especially important. First, all interfacial surfaces must be thoroughly cleaned and prepared prior to affixation. Any extraneous lint or contaminants thereon may appear prominently within the final product. Second, it is important that the visual indicia be properly centered prior to curing of the adhesive. Otherwise, the visual indicia will appear off-center, resulting in a finished product having a defective appearance.

Notwithstanding the above-described embodiments, various changes may be made in the form, construction, and arrangement of the multiplet jewelry products of the present invention without departing from the spirit and scope thereof, which shall be interpreted in accordance with the following claims.

I claim:

1. A method of preparing a multiplet jewelry product with internally embedded visual indicia comprising the steps of:

providing a first layer of transparent material and a second layer of gemstone material, said first and second layers each having an interfacial surface;

affixing visual indicia in the form of a coating of at least one colored material to at least one of said interfacial surfaces, said coating covering only selected portions of said interfacial surfaces, with the regions of said interfacial surfaces adjacent said selected portions being exposed and uncovered in order to produce a discontinuous design on said interfacial surfaces; and securing said interfacial surface of said first layer of transparent material to said interfacial surface of said second layer of gemstone material after said affixing of said visual indicia to at least one of said interfacial surfaces, and securing together of said interfacial surfaces being accomplished by the use of an adhesive material to secure said first layer of transparent material and second layer of gemstone material together in order to form a composite unit with said visual indicia therein.

2. A method of preparing a multiplet jewelry product with internally embedded visual indicia comprising the steps of:

providing a first layer of transparent material and a second layer of gemstone material, said first and second layers each having an interfacial surface;

depositing a coating of at least one colored material on at least one of said interfacial surfaces;

selectively removing at least one portion of said coating of colored material after said depositing thereof so as to form a design, said portion being removed in its entirety in order to expose said interfacial surface thereunder, whereby said design appears to be suspended within said completed multiplet jewelry product; and securing said interfacial surfaces together after said removing of at least one portion of said coating of colored material, said securing together of said interfacial surfaces being accomplished by the use of an adhesive material to secure said first layer of transparent material and second layer of gemstone material in order to form a composite unit with said design therein.

3. The method of claim 2 wherein said coating of colored material is deposited on said interfacial surface of said first layer.

4. The method of claim 2 wherein said coating of colored material is deposited on said interfacial surface of said second layer.

5. The method of claim 2 wherein said coating of colored material is deposited on said interfacial surface of said first layer and on said interfacial surface of said second layer.

6. The method of claim 2 further comprising the step of polishing at least one of said interfacial surfaces prior to depositing said coating of colored material thereon.

7. The method of claim 2 wherein said coating of colored material is deposited on a layer of material having at least one transparent area therein, said layer of material and coating of colored material thereon being affixed to at least one of said interfacial surfaces.

8. The method of claim 2 wherein said coating of colored material comprises a layer of metal.

9. The method of claim 2 wherein said coating of colored material comprises a material selected from the group consisting of paint, dye, ink, and stain.

10. The method of claim 2 wherein said first layer of transparent material is comprised of a substance selected from the group consisting of diamond, corundum, spinel, quartz, glass, cubic zircionia, strontium titanate, beryl, topaz, and plastic.

11. The method of claim 2 wherein said second layer of gemstone material is comprised of a substance selected from the group consisting of diamond, corundum, beryl, topaz, quartz, jadite, nephrite, lapis lazuli, opal, tiger-eye, obsidian, basalt, spinel, glass, cubic zirconia, strontium titanate, polycrystalline silica, onyx, mother-of-pearl, and zircon.

12. The method of claim 2 wherein said first layer of transparent material further comprises at least one non-transparent area therein.

13. A method of preparing a multiplet jewelry product with internally embedded visual indicia comprising the steps of:

providing a first layer of transparent material and a second layer of gemstone material, said first and second layers each having an interfacial surface;

depositing a coating of at least one metal on at least one of said interfacial surfaces;

covering said coating of metal with a layer of photoresist material;

removing selected portions of said photoresist material to uncover said coating of metal thereunder;

removing said uncovered portions of said coating of metal while leaving said portions thereof still covered by said photoresist material intact; and securing said interfacial surfaces of said first and second layers together after said removing of said uncovered portions of said coating of metal.

14. The method of claim 13 wherein said securing is accomplished by the application of an adhesive material to at least one of said interfacial surfaces.

15. A method of preparing a multiplet jewelry product with internally embedded visual indicia comprising the steps of:

providing a first layer of transparent material and a second layer of gemstone material, said first and second layers each having a planar interfacial surface;

cleaning said planar interfacial surface of said first layer of transparent material to remove contaminants therefrom;

depositing a coating of zirconium on said planar interfacial surface of said first layer of transparent material;

depositing a coating of gold on said coating of zirconium;

heating said zirconium and gold coatings to produce a composite gold layer;

covering said composite gold layer with a layer of photoresist material;

exposing to light selected portions of said photoresist material;

removing said portions of said photoresist material exposed to light, thereby uncovering said portions of said composite gold layer thereunder;

removing said uncovered portions of said composite gold layer while leaving said portions of said gold layer still covered by said photoresist material intact;

applying an adhesive material to at least one of said interfacial surfaces of said layers of material; and securing said interfacial surfaces of said first and second layers together using said adhesive material.

* * * * *

UNITED STATES PATENT AND TRADEMARK OFFICE

CERTIFICATE OF CORRECTION

PATENT NO. : 4,809,417

DATED : March 7, 1989

INVENTOR(S) : George W. Norman Jr.

It is certified that error appears in the above-identified patent and that said Letters Patent is hereby corrected as shown below:

In comparing the printed patent with the papers in the attorney's files, the following printing errors were noted:

In the Abstract:

Line 8: before the word "selected", delete "a".

In the Specification:

Column 3, line 50, "pitch" should be "potch".

Column 3, line 66, insert a "." after the word "material".

Column 4, line 12, the upper case letter "S" in the word "AS" should be a lower case "s".

Column 4, line 29, insert a "." after the word "adhesives".

Column 6, line 9, delete the hyphen after the word "contaminants", but leave a space.

Column 6, line 21, insert a "." after the closed parenthesis following the word "type".

Column 6, line 25, insert a "." after the word "coating".

Column 6, line 54, "goldlayer" should be "gold layer".

In the Claims:

Column 8, line 47, insert the word "together" between the words "material" and "in".

Signed and Sealed this

Twenty-first Day of November, 1989

*Attest:*

JEFFREY M. SAMUELS

*Attesting Officer* *Acting Commissioner of Patents and Trademarks*